United States Patent [19]

Perez et al.

[11] Patent Number: 4,461,504

[45] Date of Patent: Jul. 24, 1984

[54] TENNIS BALL RETRIEVER AND CARRIER

[76] Inventors: Pedro Perez; Pedro Perez, Jr., both of 31 Nelson Ave., Harrison, N.Y. 10528

[21] Appl. No.: 418,223

[22] Filed: Sep. 15, 1982

[51] Int. Cl.[3] ..... A47F 13/06

[52] U.S. Cl. ..... 294/19 A; 248/132; 280/47.34

[58] Field of Search ..... 248/132, 157; 220/69; 294/19 A; 190/18 R, 18 A; 211/207, 208, 126, 181; 280/47.34, 47.35

[56] References Cited

U.S. PATENT DOCUMENTS

| | | | |
|---|---|---|---|
| 588,253 | 8/1897 | Wagner | 248/132 X |
| 3,371,950 | 3/1968 | Stap | 294/19.2 X |
| 3,820,836 | 6/1974 | Seewagen et al. | 294/19.2 |
| 3,855,946 | 12/1974 | Bales | 403/379 X |
| 3,889,996 | 6/1975 | Campbell | 294/19.2 |
| 3,926,465 | 12/1975 | Hoagland et al. | 294/19.2 |
| 4,193,625 | 3/1980 | Nelson | 294/19.2 |

FOREIGN PATENT DOCUMENTS

| | | | |
|---|---|---|---|
| 7901620 | 9/1980 | Netherlands | 294/19.2 |

*Primary Examiner*—David M. Mitchell
*Assistant Examiner*—Michael Mar
*Attorney, Agent, or Firm*—Curtis Ailes

[57] ABSTRACT

The structure includes a container having a bottom wall with slotted apertures having thin parallel side edge members through which tennis balls can be squeezed. At least one edge member of each aperture includes a roller to reduce the frictional resistance to the entry of the ball through the aperture. A support is provided for supporting the container with the bottom wall spaced above the supporting surface to prevent wear on the bottom wall.

6 Claims, 6 Drawing Figures

TENNIS BALL RETRIEVER AND CARRIER

This invention relates to a retriever and carrier for tennis balls which is of the type which admits the tennis balls through an opening in the bottom of the carrier so as to pick up and gather the tennis balls from the surface of the tennis court.

BACKGROUND OF THE INVENTION

The present invention is an improvement upon tennis ball retrievers such as shown in U.S. Pat. Nos. 3,371,950 Stap, and 3,820,836 Seewagen et al.

The Stap patent provides a tennis ball retriever and storage unit including a receptacle with a grate forming the bottom wall. Fixed bars form the grate and are spaced apart at a dimension slightly less than the diameter of the tennis ball so that the ball may be squeezed between the bars to gain entry into the receptacle. Thus, the container may be carried around the tennis court and the bottom of the container may be pressed against loose tennis balls which cause those balls to be squeezed through the bottom grate and into the container. The container, which is filled with balls, is then typically carried to the back line of the tennis court by the player who wishes to practice his serve to provide a supply of balls for that purpose. After the balls are spread around the court, they are gathered again by the retriever.

The Seewagen patent provides a similar structure for the same purpose. The structure includes narrow hinged door-like elements in the bottom of the container to permit ingress of balls through the bottom of the container and to prevent reverse flow of the balls out of the container. The Seewagen patent also provides for two handle members which may be hinged downwardly to provide legs to raise the container to place the container at a more convenient height for manual removal of the balls.

The structure disclosed in the above mentioned prior patents serve a very useful function, but have serious disadvantages and shortcomings as follows:

The users typically use the device of the Stap patent, in particular, in a rather rough manner so as to cause substantial friction and wear upon the bottom structure. This is because of the considerable force required to squeeze balls through the bottom grating, and because the container becomes heavy, and is often dragged along the surface of the tennis court.

Because the balls are squeezed between two bars for ingress into the container in the Stap structure, there is considerable frictional wear on the surface of the balls, tending to remove the outer fuzz on the balls, and changing the playing characteristics of the balls because of that change.

The Stap structure has the further disadvantage that, when once filled, the player must stoop down to pick balls out of the container for each serve. The attempt to solve this problem by the hinged handles of the Seewagen et al patent is not very satisfactory because the downfolded handles do not raise the container very high, and the arrangement is rather makeshift and unstable.

The door-like elements in the Seewagen et al patent are expensive and subject to malfunction.

Accordingly, it is an object of the invention to overcome the various disadvantages and shortcomings of the above described prior U.S. patents.

More specifically, it is an object of the present invention to provide an improved tennis ball retriever and carrier which is not only simple, but which avoids the substantial friction and wear upon the tennis balls.

Another object of the invention is to provide an improved tennis ball retriever and carrier which, by the nature of its design, is less subject to physical wear and breakage, and which is better capable of withstanding wear, particularly upon the container bottom.

It is another object of the present invention to provide a tennis ball retriever and carrier which includes improved means for raising the height of the carrier after the tennis balls have been collected.

Further objects and advantages of the invention will be apparent from the following description and the accompanying drawings.

SUMMARY OF THE INVENTION

In carrying out the invention, there is provided a tennis ball retriever and carrier comprising a container having a bottom wall, said bottom wall including at least one slotted aperture having thin parallel side edge members spaced apart by a dimension which is just a little less than the diameter of a standard tennis ball so as to permit entry of a tennis ball into said container through said aperture by squeezing the ball through said aperture, at least one of said edge members of said aperture including at least one roller to reduce the frictional resistance to the entry of the ball through said aperture.

DESCRIPTION OF PREFERRED EMBODIMENT

Figure 1:
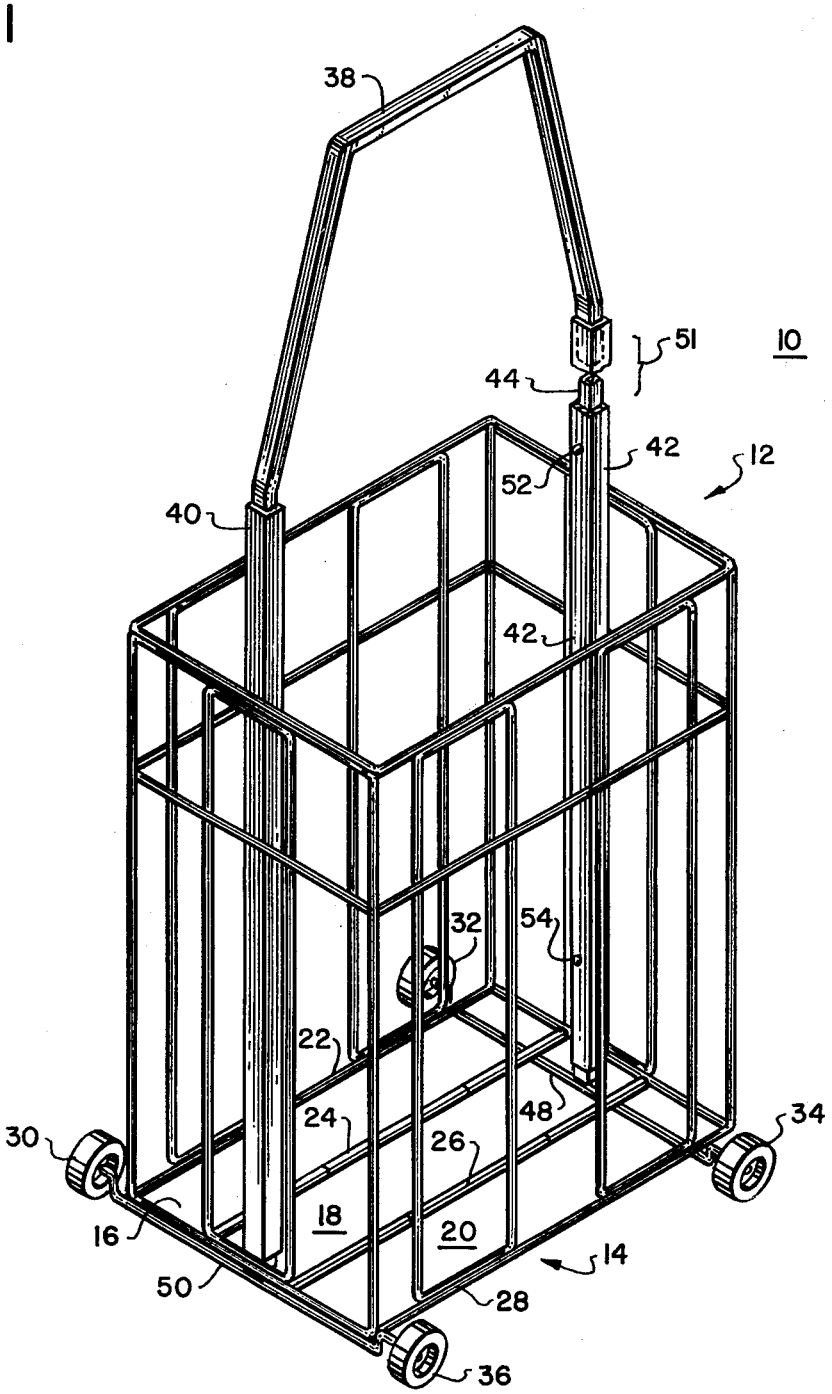
FIG. 1 is a perspective view of a preferred embodiment of the invention.

FIG. 1 is a perspective view of a preferred embodiment of the invention. It consists of a tennis ball retriever and carrier 10 including a container 12 having a bottom wall 14 including three slotted apertures 16, 18, and 20. These slotted apertures have thin parallel side edge members 22, 24, 26, and 28. These edge members are spaced apart by a dimension which is just a little less than the diameter of a standard tennis ball so as to permit entry of a tennis ball into the container 12 through any one of the apertures by squeezing the ball through the aperture. For instance, a standard tennis ball is about 2⅝ inches in diameter, and the width of the aperture may typically be about 2 3/16 inches. At least one of the edge members of each aperture includes at least one roller to reduce the frictional resistance to entry of the balls through that aperture. Thus, each of the edge members 24 and 26 includes rollers so that each of the apertures 16 and 20 includes rollers for at least one edge member, and the aperture 18 has rollers on both edge members. The edge members 24 and 26 serve both the center aperture 18 and the respective side apertures 16 and 20.

The structure also includes a supporting means for supporting the container with the bottom wall 14 spaced substantially above a supporting surface, such as the surface of the tennis court. The supporting means includes, in the preferred embodiment, four wheels 30, 32, 34, and 36. The diameter of the wheels and the arrangement of their attachment to the carrier 12 is such as to support the container so as to space the edge members 22–28 of the apertures 16, 18, and 20 at a level substantially less than the radius of a standard tennis ball above the supporting surface to provide for admission of a tennis ball through any one of the apertures when the container is lowered over the tennis ball with the aperture in registration with the tennis ball. Thus, for instance, the spacing of each of the edge members to the supporting surface, when the container is resting upon the wheels 30–36, may be about ¾ of an inch. The radius of the ball is about 1 5/16 inches.

The roller edge members 24 and 26 each consist preferably of one or more rotatable sleeves mounted and supported upon a rod.

As illustrated in FIG. 1, the container 12 is preferably in the form of a wire basket having an open top, and includes a carrying handle 38. The container 12 is preferably rectangular, as pictured, and has vertical sides. However, it will be apparent that other shapes are possible without departing from the scope of the invention. Mounted at the interior of each vertical end panel of the container 12, there is a metal tube 40, 42, which preferably has a square cross section. The handle 38 is preferably attached to the container by attachment within the top of each of the tubes 40 and 42. This attachment may be accomplished by welds. Within each tube 40 and 42, there is telescopically arranged an extendible leg 44, 46, as shown most clearly in FIG. 5. At the bottom of each leg 44, 46, there is firmly attached a crossbar 48, 50, and the crossbars 48, 50, form axles to which the wheels are rotatably attached. Thus, in the preferred form of the invention, the supporting means for the ball retriever and container includes the telescopically extendible legs 44, 46, the crossbars 48, 50, as well as the wheels 30–36, and the supporting tubes 40, 42, for the extendible legs. By extension of the legs, the carrier may be raised, after it is filled with balls, so that the balls are at a more convenient height for the user.

At the top of tube 42, in FIG. 1, the inserted and attached end of handle 38 is shown dotted. Also the tube 42 is cut away at 51 to show the top end of leg 44. As shown in the drawings, the crossbars (axles) 48 and 50 are offset at the ends to lower the bottom 14 of the container with respect to the wheels. Alternatively, small diameter wheels may be used.

Providing wheels 30–36 for the support of the carrier is obviously a substantial advantage for the user because the carrier can be moved around on the wheels, without requiring the full weight of the carrier and the balls to be lifted and carried by the user and without dragging. Furthermore, when balls are to be squeezed through one of the bottom apertures 16, 18, 20, the carrier may simply be tilted back on two of the wheels, raising the other two, until the bottom of the carrier is placed in registration over the ball which is to be picked up. The carrier may then be tilted back down over the ball so as to cause the ball to be squeezed through one of the apertures.

Each extendible leg 44, 46, is preferably provided with a positioning device to maintain that leg in each desired position. The positioning device may consist of a conventional spring biased pin 52 which is adapted to extend transversely out of the leg and into a positioning hole in the associated tube 40, 42. A hole 54 to accommodate the pin 52 when the leg 46 is in the extended position is indicated in the drawing. This structure is further shown in FIG. 6.

Figure 2:
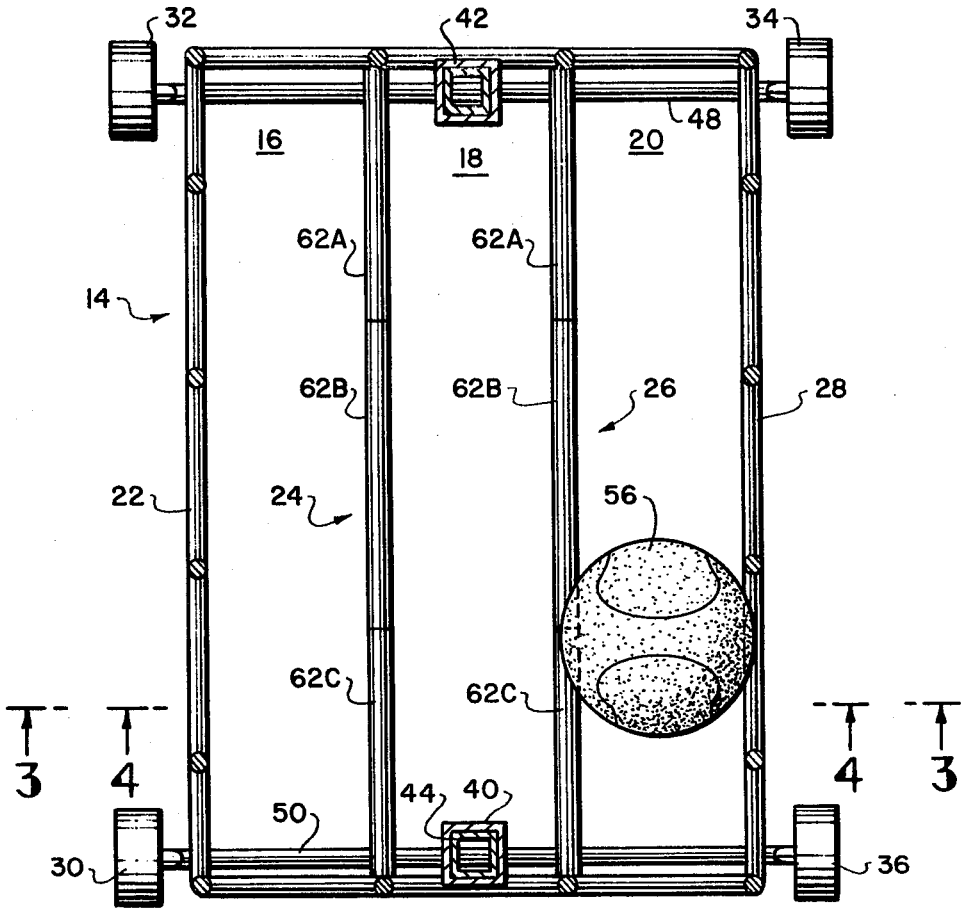
FIG. 2 is a sectional view of the bottom as viewed from the top of the embodiment of FIG. 1 with one tennis ball shown to illustrate the dimensional relationship between the tennis ball and the apertures in the bottom of the device.

FIG. 2 is a sectional top view of the bottom portion of the structure of FIG. 1 and illustrating the dimensional relationship between the tennis ball 56 and the spacing between the edge members 26 and 28.

Figure 3:
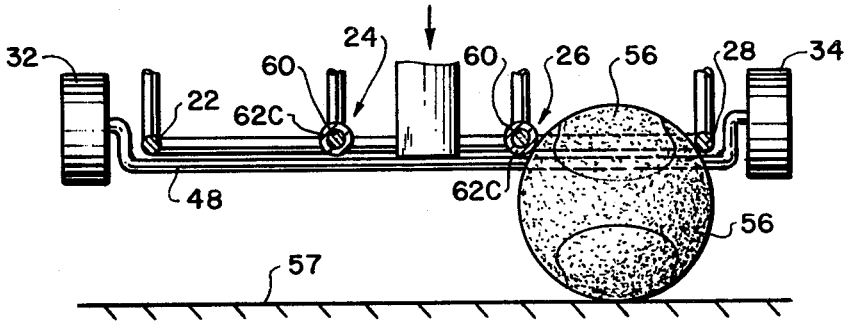
FIGS. 3 and 4 are both partial sectional end views of the embodiment of FIG. 1 taken at the bottom portion thereof and illustrating how a tennis ball enters the container through the bottom apertures.

FIG. 3 is a sectional view taken at 3—3 in FIG. 2 and illustrating how the carrier is placed over one of the balls 56, while the ball is in contact with the supporting surface, and with the aperture 20 in registration with the ball 56 for squeezing the ball 56 into the carrier by downward pressure on the carrier.

Figure 4:
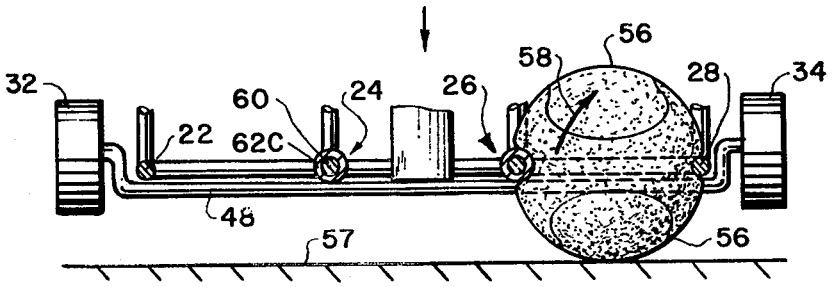

FIG. 4 is another section view taken at section 4—4, which happens to be the same as section 3—3, and showing the action of the carrier as the ball 56 is squeezed through the aperture 20. Since edge member 26 includes a roller, and edge member 28 does not, the surface of the ball tends to rotate upon the roller edge member 26, and to pivot about the contact between the ball and the edge member 28 so as to cause rotation of the ball as it is squeezed through the aperture, as indicated by the arrow at 58. It is to be appreciated, therefore, that the ball is not rubbed or scuffed as it is squeezed through the aperture 20, even though a roller is provided on only one of the edge members 26 of the aperture 20. It is obvious that the same effect is available at aperture 16. For the center aperture 18, formed by the edge members 24 and 26, rollers are provided on both sides so that scuffing and rubbing of the surface of the ball is avoided without the necessity for a pivoting motion of the ball as it enters through the aperture.

The edge members 24 and 26, each of which include a roller, are each preferably formed by a support rod 60 surrounded by one or more sleeves 62. As illustrated in FIG. 2, there are preferably at least three sleeves 62A, 62B, and 62C for each of the edge members 24 and 26. The sleeves 62A, B, and C are arranged end to end upon the associated rod 60. The advantage of providing multiple sleeves is that the sleeves may rotate independently of one another, thus assuring less friction and resistance to rotation upon the admission of a ball to the carrier. Furthermore, the provision of a plurality of sleeves arranged end to end upon the single support rod 60 permits the sleeves to rotate easily even though the rod 60 may become deformed slightly because of the forces applied to the rod 60 in the course of squeezing the balls through the apertures, or for other reasons.

Various materials may be used for the support rod 60 and the sleeve 62. A preferred combination is a steel rod 60 wit copper sleeves 62. It will be apparent also that various synthetic resin materials may be used for sleeves 62, such as a polyethylene or one of the nylons. Those materials possess natural lubricating properties, and are tough and flexible.

Figure 5:
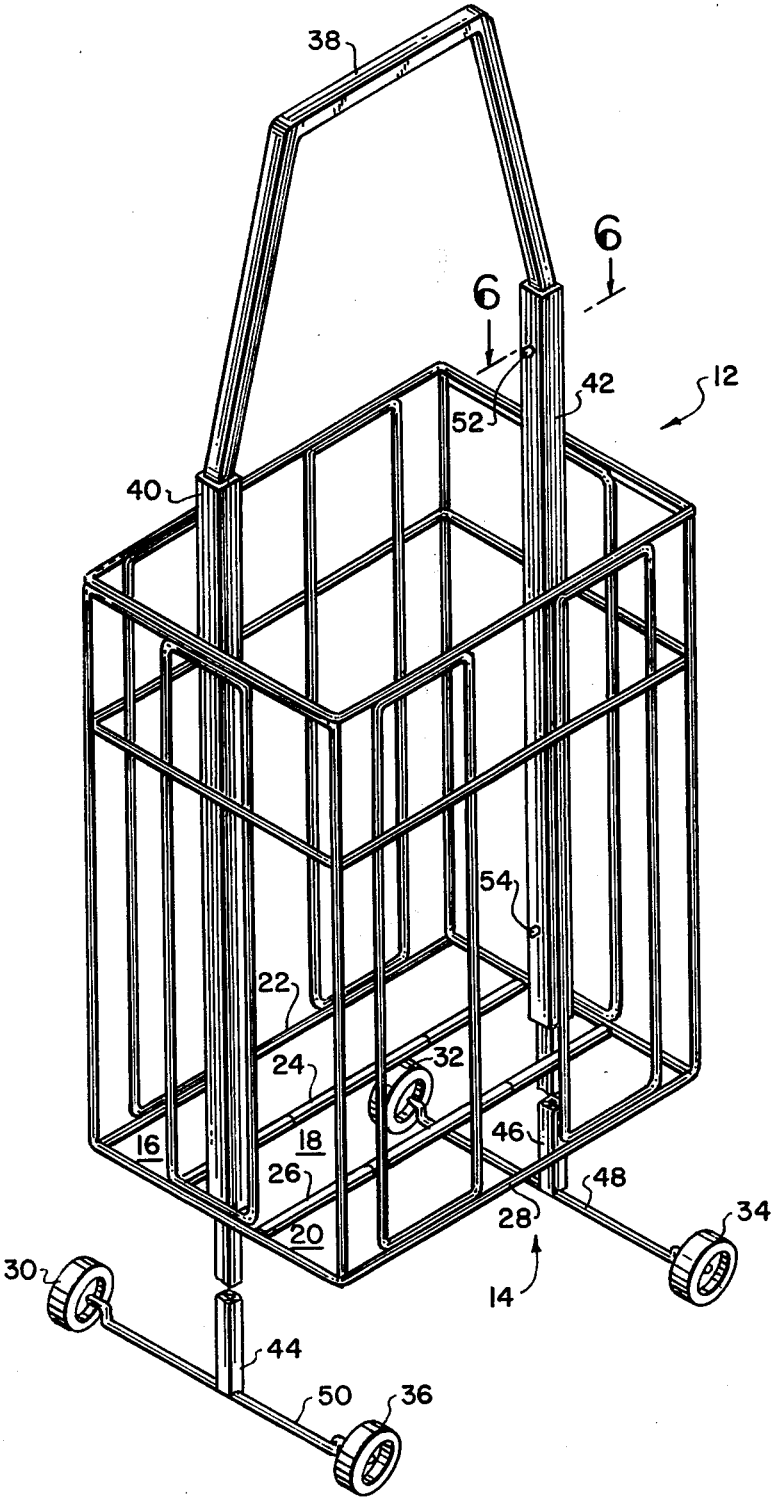
FIG. 5 is a perspective view of the preferred embodiment of FIG. 1, and illustrating the extension of the supporting legs.

FIG. 5 illustrates the embodiment of FIG. 1 with the legs 44 and 46 extended. As illustrated in FIG. 5, as well as in FIGS. 3 and 4, the crossbars 48 and 50 are preferably offset at the ends so that the main body of the crossbar, or axle, is substantially lower than the centers of the associated wheels. This permits the bottom of the container to be substantially lower in relation to the supporting surface than would otherwise be possible with straight crossbars which rest under the lower surface of the container. This arrangement is necessary in order to have wheels 30–36 of reasonable diameter, and still maintain a close clearance to the supporting surface for reliable pickup of the balls by squeezing through the bottom apertures.

The legs 44 and 46 are shown "broken" in FIG. 5 to indicate that the legs are somewhat longer than shown in the drawing. Typically, those legs are as long as they can be for comfortable accomodation within the respective tubes 40 and 42 in order to provide for a substantial elevation of the basket above the supporting surface when the legs are extended. In a preferred embodiment, the legs are extended about 13 inches to provide an elevation of the bottom of the basket at about 14 inches, with the elevation of the top of the basket at about 30 inches. It will be obvious, however, that these dimensions are not critical, and that they may be varied without departing from the scope of the invention.

Figure 6:
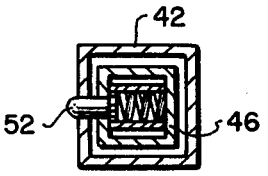
FIG. 6 is an enlarged sectional detail illustrating the telescoping structure of the extendible legs.

FIG. 6 is a horizontal sectional view of the tubing 42 at the pin 52 (section 6—6 in FIG. 5) illustrating how the leg 46 is telescopically fitted within the tube 42, and how the locking pin 52 is mounted within the leg 46 to project through an opening in the tube 42. As illustrated in FIG. 6, the leg 46 and the tube 42 are preferably at least rectangular, and may preferably by square, as illustrated, to prevent relative rotation of the leg 46 within the tube 42. The clearance between the inside of tube 42 and the outside of leg 46 is exaggerated in FIG. 6 for clarity.

While this invention has been shown and described in connection with a particular preferred embodiment, it is apparent that various changes and modifications, in addition to those mentioned above, may be made by those who are skilled in the art without departing from the basic features of the invention. Accordingly, it is the intention of the applicant to protect all variations and modifications within the true spirit and valid scope of this invention.

We claim:

1. A tennis ball retriever and carrier comprising a container having a bottom wall, said bottom wall including at least one slotted aperture having thin parallel side edge members spaced apart by a dimension which is just a little less than the diameter of a standard tennis ball so as to permit entry of a tennis ball into said container through said aperture by squeezing the ball through said aperture, at least one of said edge members of said aperture including at least one roller to reduce the frictional resistance to the entry of the ball through said aperture, support means for supporting said container with said bottom wall spaced substantially above a supporting surface to prevent wear on said bottom wall, said supporting means being dimensioned to space said edge members of said aperture at a level substantially less than the radius of a standard tennis ball above the supporting surface to provide for admission of a tennis ball through said aperture when said container is lowered over the tennis ball with the aperture in registration with the tennis ball, said container being substantially rectangular, and said support means comprising four support wheels positioned adjacent to the corners of said bottom of said container, said support means including slidably lowerable legs to raise the height of said container after a group of balls have been retrieved.

2. A structure as claimed in claim 8 wherein there are provided a plurality of said apertures in said bottom wall of said container, said apertures being parallel to one another and forming a grid with a common edge member for each pair of adjacent apertures, said common edge member being the member including a roller.

3. A structure as claimed in claim 1 wherein each of said bottom edge members including a roller comprises at least one rotatable sleeve mounted and supported upon a rod.

4. A structure as claimed in claim 3 wherein each of said edge members including a roller comprises a plurality of rotatable sleeves arranged end to end upon a single rod.

5. A structure as claimed in claim 1 wherein said support means comprises two lowerable legs with a crossbar arranged at the bottom of each leg and with a wheel rotatably mounted at the end of each crossbar.

6. A structure as claimed in claim 5 wherein said slidably lowerable legs are rectangular in cross section and are each telescopically fitted within a rectangular cross section sleeve forming a part of said container.

* * * * *

UNITED STATES PATENT AND TRADEMARK OFFICE

CERTIFICATE OF CORRECTION

PATENT NO. : 4,461,504

DATED : July 24, 1984

INVENTOR(S) : PEDRO PEREZ & PEDRO PEREZ, JR.

It is certified that error appears in the above-identified patent and that said Letters Patent are hereby corrected as shown below:

COLUMN 4, LINE 57, "wit copper" should read --with copper--.

COLUMN 6, LINE 22, "as claimed in claim 8" should read --as claimed in claim 1--.

Signed and Sealed this

*Nineteenth* Day of *February 1985*

[SEAL]

*Attest:*

DONALD J. QUIGG

*Attesting Officer* *Acting Commissioner of Patents and Trademarks*